US006818255B1

(12) United States Patent
Zimmer et al.

(10) Patent No.: US 6,818,255 B1
(45) Date of Patent: Nov. 16, 2004

(54) METHOD FOR MARKING A THERMOPLASTIC MATERIAL

(76) Inventors: Michael Zimmer, 66133 Saarbrucken, Beerenfeldstr. 11 (DE); Bernd Schultheis, 55270 Schwahenheim, Silvaner Weg 2 (DE)

( * ) Notice: Subject to any disclaimer, the term of this patent is extended or adjusted under 35 U.S.C. 154(b) by 0 days.

(21) Appl. No.: 09/641,595

(22) Filed: Aug. 18, 2000

(30) Foreign Application Priority Data

Mar. 9, 1999 (DE) ..... 199 42 055

(51) Int. Cl.[7] ..... B05D 1/04; B05D 7/24; G03G 15/16

(52) U.S. Cl. ..... 427/466; 427/485; 427/195

(58) Field of Search ..... 427/458, 466, 427/475, 485, 180–201, 322, 469, 316; 264/132, 134–136, 446, 447, 131, 336; 101/487; 430/97–99, 106.6, 109, 102, 136; 347/185, 172, 112, 113, 120

(56) References Cited

U.S. PATENT DOCUMENTS 3,893,761 A 7/1975 Buchan et al.
4,140,463 A * 2/1979 Brinkmann et al.
4,162,884 A * 7/1979 Vetter
4,489,122 A * 12/1984 Kammin et al.
4,510,225 A * 4/1985 Kuehnle et al. ..... 430/126
4,927,727 A * 5/1990 Rimai et al.
5,102,767 A * 4/1992 Chowdry et al.
5,112,717 A * 5/1992 Baxter et al.
5,392,096 A * 2/1995 Deets, II
5,629,050 A * 5/1997 Silvis et al.
5,920,756 A * 7/1999 Matsuda et al.

FOREIGN PATENT DOCUMENTS

DE 2353577 10/1973
GB 1 264 494 * 2/1972

OTHER PUBLICATIONS

Hawley's Condensed Chemical Dictionary, 13th ED. p. 525, dated 1997.*
Modem Dictionary of Electronics, Rudolf F. Graf, p. 1046, 1984 6th Edition, 1984.*
McGraw–Hill Dictionary of Scientific and Technical Terms, 1994 5th Edition, p. 2041, 1994.*

* cited by examiner

*Primary Examiner*—Fred J. Parker
(74) *Attorney, Agent, or Firm*—Jansson, Shupe & Munger, Ltd.

(57) ABSTRACT

The invention pertains to a method for printing on a thermoplastic material, wherein a coloring agent is applied to the surface of the material and is subsequently caused to harden. In order to achieve permanent coloration of the material to be printed, the method according to this invention provides that as coloring agent, a toner featuring thermoplastic toner particles is applied by electrographic or electrostatic means to the surface of the material, and that the toner and/or at least a portion of the surface of the material is brought into a reactive state in that the toner makes a permanent bond with the surface.

20 Claims, 1 Drawing Sheet

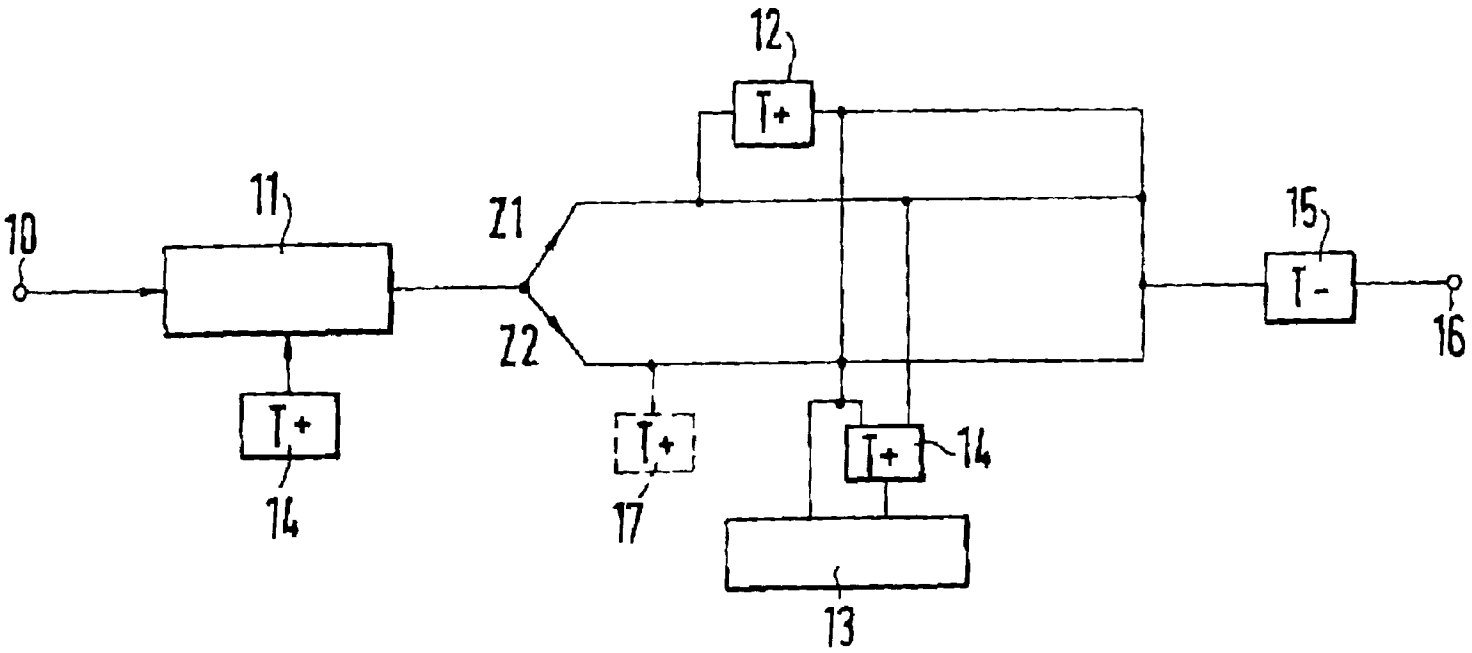
10
11
T+
14
Z1
Z2
12
T+
T+
17
14
T+
13
15
T-
16

METHOD FOR MARKING A THERMOPLASTIC MATERIAL

RELATED APPLICATION AND CLAIM OF PRIORITY

This application claims priority from German patent application DE 199 42 055.6-45 filed Sep. 3, 1999.

FIELD OF THE INVENTION

The invention pertains to a method for printing on a thermoplastic material, where a coloring agent is applied to the surface of the material and is subsequently caused to harden.

BACKGROUND OF THE INVENTION

Various printing methods are known from the prior art, for example, silk screen, tampon printing or the flexoprint method. With these methods, solvent-containing dye is applied onto the thermoplastic material. The solvent is evaporated, so that the dye can harden. Some time after manufacture of the thermoplastic material, chemical reactions occur between the material surface and the formerly very difficult to scrape off dye, which adversely affect adhesion.

OBJECTS OF THE INVENTION

It is an object of the invention to create a method of the kind described above, wherein permanent coloration can be achieved on the material to be printed.

SUMMARY OF THE INVENTION

The invention involves a method whereby as coloring agent, a toner featuring thermoplastic toner particles, is applied by electrographic or electrostatic means to the surface of the material, and that the toner and/or at least a portion of the surface of the material is brought into a reactive state in that the toner makes a permanent bond with the surface.

The thermoplastic toner particles enter into a permanent bond with the material, which later, in the hardened state, cannot be readily relaxed again. Thus, permanent bonding of the coloring agent can be achieved. Because the coloring agent is applied in the form of a toner by electrographic or electrostatic means onto the material, a flexible printing process is possible, since even complicated printed patterns can be produced in very small lot sizes.

According to one preferred configuration variant of the invention, this method provides in particular for the surface of the material to be brought into a fluid or dough-like state by means of thermal energy.

One possible variant of the invention is characterized in that the thermoplastic material is processed in a molding machine under the influence of temperature, that the processed material is additionally heated at least in regions of its surface to produce the reactive state, or is kept in this reactive state under the influence of temperature, and that the toner is subsequently applied to the surface to be printed. Thus, in this case the printing process will directly follow the molding process.

According to another method of this invention, it is also provided that the thermoplastic material be processed in a molding machine under the influence of temperature, that subsequent to the molding process, the processed material be caused to harden (state Z1), and that the hardened material subsequently be sent to a warming device and brought into the reactive state at least in regions of its surface.

With regard to the two aforementioned methods, the toner can be brought to the reactive state by means of a warming device, or the toner can be brought into the reactive state by the thermal energy present in the material.

In addition, a process control is possible which is disconnected from the actual molding process. In this case, the invention provides that the thermoplastic material be processed in a molding machine under the influence of temperature, that subsequent to the molding process, the processed material be caused to harden (state Z1), that the toner be brought into the reactive state in a warming device before application to the surface of the material to be coated, and that the surface of the heated toner be partially brought into the reactive state.

In order to ensure dependable hardening of the coloring agent, the invention also provides that subsequent to the coloration process, after the coloring agent has bonded with the surface of the material, said material is brought into the hardened state together with the coloring agent in a cooling section.

As a result of the printing process, in order to cause little or no effect on the surface quality of the material, yet another method according to this invention provides that the coloring agent be sunken into the surface of the material to form a smooth surface structure. In this way, a homogeneous, smooth surface can be produced.

Preferably, the thermoplastic toner particles are of the same thermoplastic material as the material to be coated.

BRIEF DESCRIPTION OF THE DRAWINGS

The drawings illustrate preferred embodiments which include the above-noted characteristics and features of the invention. The invention will be readily understood from the descriptions and drawings. In the drawings:

FIG. 1 is a schematic illustration of the process flow.

DETAILED DESCRIPTION OF PREFERRED EMBODIMENTS

As is evident in the figure, a material 10 in the raw state is supplied to a molding machine 11. The molding machine, for example, can be an injection molding machine, an extruder or such. The molding machine 11 is associated with a warming device 14. By means of this warming device 14, the material 10 will be brought into the fluid or dough-like state. In conjunction with the molding process, printing of the entire material surface or a portion thereof will occur. In this case, a distinction is made in the process diagram between two states Z1 and Z2. According to state Z1, the material is caused to completely harden. The hardened material can then be transported or, for example, processed intermediately. Next, it is sent to a warming device 12. In this warming device 12, at least the surface of the material 10 to be printed is brought into a dough-like or fluid reactive state by means of thermal energy. By means of a printing device 13, a toner can be applied to the surface to be printed. The toner contains thermoplastic toner particles and dye pigments. If the toner is designed as a single component toner, then additional clarity control agents are also present in the toner. Also, the use of a two-component toner is possible, to which a developer in the form of ferromagnetic particles has been added.

This toner will be applied electrographically or electrostatically to the surface of the material. Now, in this regard it is possible for the toner to be applied in its raw state directly to the surface of the material, or for the toner to be brought into the fluid or dough-like reactive state by means of a warming device 14. The toner can be added either before or after the warming device 12 in which the hardened material 10 is heated. If the toner is supplied to the material in the raw state, that is, not via the warming device 14, then conversion of the toner to the reactive state is caused either by the warming device 12, or directly by contact with the heated material 10. After the toner has been applied to the material 10 and has been brought into the reactive state, it will bond with the material 10 to form a permanent structure.

It is also possible that the hardened material 10 will not be supplied to the warming device 12, as is shown in the process outline. It is possible to apply to the material 10 a toner which was first brought to the reactive state by means of the warming device 14. Based on the temperature level of the toner, the surface of the material 10 will be locally melted, so that the coloring agent can bond with the surface; in particular, so it can sink into it.

It is also possible that the material 10 will be directly subjected to the dye treatment subsequent to the molding machine 11. In this case, at least the surface of the material 10 is still in the unhardened state Z2. If necessary, this state can be maintained with a supplemental heating device 17. Then, also, a toner can be applied to the surface of the material 10 with the printing device 13. The toner can either be applied to the surface in the raw state, or it can be pretreated with the warming device 14.

After the coloring agent has been applied onto the material 10, the material will pass through a cooling section 15 where toner is caused to harden. After the printing process, the finished, printed workpiece 16 will be ready to use. Preferably, the thermoplastic toner particles of the toner consist of the same material as the material 10, in order thus to obtain a consistent material composition. Preferably, the method according to this invention will be used for the following materials: polyethylene, polypropylene, polystyrene, polycarbonate and ABS [acrylonitrile butadiene styrene].

Possible application examples for the new printing method are, for example, decoration of polycarbonate blends for household appliances, or printing of labels for compact disks, including bar codes, serial numbers or manufacturer data.

In addition, it is possible to provide polypropylene web plates with customer-related information (e.g., for the beverage industry). In the pharmaceutical industry, an individual batch code or identifier can be printed onto plastic packaging. To bring the thermoplastic material from the hardened state into the reactive state, the warming devices 12, 14, 17 can be designed as infrared emitters or as lasers which heat up only the near-surface layers of the material 10. Thus, deformation problems from thermal effects will be prevented.

While the principles of this invention have been described in connection with specific embodiments, it should be understood clearly that these descriptions are made only by way of example and are not intended to limit the scope of the invention.

What is claimed is:

1. A method of producing a finished printed workpiece, the method comprising:

supplying a thermoplastic material in a raw state to a processing machine;

processing the material, including heating and molding the material into a molded material, the molded material having a surface, the surface being heated to and kept at a material reactive state;

while the surface of the molded material is in the material reactive state due to the processing, printing a toner directly onto the surface of the molded material, the toner including thermoplastic toner particles; and hardening the molded material thereby establishing a permanent bond between the toner and the molded material to form the finished printed workpiece.

2. The method of claim 1 wherein only the surface of the molded material is heated to the material reactive state.

3. The method of claim 2 wherein the surface of the molded material is heat-softened in the material reactive state.

4. The method of claim 3 wherein the toner particles are fluid before the hardening.

5. The method of claim 4 wherein the toner particles are of the same composition as the thermoplastic material.

6. The method of claim 5 wherein the toner particles and the molded material are selected from the group consisting of polyethylene, polypropylene, polystyrene, polycarbonate, and acrylonitrile butadiene styrene.

7. The method of claim 6 wherein the toner is electrographically printed directly onto the surface of the molded material.

8. The method of claim 6 wherein the toner is electrostatically printed onto the surface of the molded material.

9. The method of claim 7 wherein the toner sinks into the surface to form a smooth surface structure.

10. The method of claim 9 wherein the thermoplastic material is processed in a molding machine to form the molded material.

11. The method of claim 9 wherein the thermoplastic material is extruded during processing to form the molded material.

12. The method of claim 1 further comprising the step of heating the toner such that the toner particles are in a toner reactive state.

13. The method of claim 12 wherein the toner particles and the surface of the molded material are fluid in their respective reactive states.

14. The method of claim 13 wherein the toner is heated by the surface of the molded material so that the toner particles reach the toner reactive state.

15. The method of claim 13 wherein the toner is heated before contact with the surface of the molded material so that the toner particles are in the toner reactive state before contact with the surface of the molded material.

16. The method of claim 1 wherein the toner is fluid.

17. The method of claim 1 wherein the toner particles are of the same composition as the thermoplastic material.

18. The method of claim 1 wherein the toner particles are fluid before the hardening action.

19. The method of claim 18 wherein the toner particles are fluid before printing.

20. The method of claim 1 wherein the toner further comprises dye pigments and ferromagnetic particles.

* * * * *